United States Patent [19]

Lautenschläger et al.

[11] 4,240,590

[45] * Dec. 23, 1980

[54] BLOWER BEATER MILL

[75] Inventors: Friedrich W. Lautenschläger, Gechingen; Hermann Hennecke, Mülheim, both of Fed. Rep. of Germany

[73] Assignee: Deutsche Babcock Aktiengesellschaft, Oberhausen, Fed. Rep. of Germany

[ * ] Notice: The portion of the term of this patent subsequent to Jul. 17, 1996, has been disclaimed.

[21] Appl. No.: 34,364

[22] Filed: Apr. 30, 1979

[30] Foreign Application Priority Data

May 18, 1978 [DE] Fed. Rep. of Germany ..... 2821637

[51] Int. Cl.[3] ..... B02C 13/10

[52] U.S. Cl. ..... 241/56; 241/67; 241/188 R; 241/191

[58] Field of Search ..... 241/56, 67, 188 R, 191, 241/194

[56] References Cited

U.S. PATENT DOCUMENTS

| | | | |
|---|---|---|---|
| 1,038,886 | 9/1912 | Hirt | 241/188 R X |
| 3,880,366 | 4/1975 | Loevenich | 241/194 |
| 4,056,232 | 11/1977 | Linnerz et al. | 241/194 |
| 4,161,293 | 7/1979 | Beelmann et al. | 241/191 X |
| 4,161,294 | 7/1979 | Lautenschläger et al. | 241/67 X |
| 4,165,295 | 7/1979 | Hennecke et al. | 241/188 R X |

*Primary Examiner*—Howard N. Goldberg
*Attorney, Agent, or Firm*—Max Fogiel

[57] ABSTRACT

A blower-beater mill for drying and milling material with a beater body and impeller arranged on the mill shaft. The beater arms of the beater body are fastened between hub rings on the shaft and water cooling is applied along the longitudinal axis of the mill shaft. The shaft is enclosed by a casing which extends to the impeller and is spaced from the shaft. In the region of the beater body, the casing has openings for the beater arms. The mill shaft also has hub rings between the beater body and the impeller. The casing is made up of U-shaped rings which overlap one or several hub rings. The rings have vertical legs inserted into passages between the hub rings. A passage behind the beater portion may be enlarged for fitting insert pins in the direction of the hub pins and lock washers may be placed between the front faces of the insert pins and the side faces of the hub rings. A gap may be located between the deflection disk of the impeller and the last U-shaped ring. The diameter of individual U-shaped rings may vary along the shaft.

5 Claims, 2 Drawing Figures

BLOWER BEATER MILL

BACKGROUND OF THE INVENTION

The present invention relates to a blower-beater mill for drying and milling material, comprising a rotor consisting of a beater body arranged on a shaft of the mill, and an impeller, in which the shaft is provided along its longitudinal axis with water cooling, in which the beater body is provided with beater arms between hub rings on the shaft and in which the shaft is surrounded by a casing which extends to the impeller and is spaced from the shaft, the casing being provided with openings for the beater arms to pass through.

The shaft of such blower-beater mills is subjected to high temperatures during the milling and drying process due to contact with hot gases. In known mills of this kind the casing which surrounds the shaft prevents the periphery thereof from getting too hot and the temperature differential along the cross-section of the shaft from being reduced too much. It has also been proposed to use a casing consisting of individual rings. The rings may have a U-shaped peripheral portion and the vertical leg of the rings may be inserted into the passages between the hub rings. In this way it is easier to dismantle the beater arms in the individual rows. The portion of the shaft between the beater body and the deflecting plate of the impeller, however, is not surrounded by a casing.

The object of the invention is to improve the blower-beater mill of the prior art in which the entire shaft which comes into contact with the hot gases is protected and in which dismantling of individual rows of blower-beater arms and casing is easier to carry out.

Another object of the present invention is to provide an arrangement of the foregoing character which is substantially simple in construction and may be economically fabricated.

A further object of the present invention is to provide a blower-beater mill, as described, which may be readily maintained in service and which has a substantially long operating life.

SUMMARY OF THE INVENTION

The objects of the present invention are achieved by providing the portion of the shaft between the beater body and the impeller with hub rings and by using a casing which consists over its entire length of individual rings having a U-shaped peripheral section whereby the rings overlap one or more hub rings and the vertical legs of the rings are inserted into passages between the hub rings.

As distinct from blower-beater mills of the prior art, the portion of the shaft between the beater body and the impeller is also provided with hub rings. It is therefore possible to use a casing consisting of rings having a U-shaped peripheral portion and to insert the vertical legs of these rings into the passages between the hub rings. This arrangement facilitates dismantling the individual rows of beater arms and makes it possible to remove and replace damaged parts of the casing. Finally, the weight of the shaft can be reduced by having passages therein.

To facilitate dismantling of the support pins which serve the purpose of fastening the beater arms, it is preferred to enlarge a passage disposed behind the beater body and to place therein insert pins in the axial direction of the support pins, and to provide safety discs between the front faces of the insert pins and the corresponding side faces of the hub rings. When using this embodiment the support pins can be removed starting at the last hub ring of the beater body whilst the support pins in the rear portion of the shaft remain in position in their bores.

The novel features which are considered as characteristic for the invention are set forth in particular in the appended claims. The invention itself, however, both as to its construction and its method of operation, together with additional objects and advantages thereof, will be best understood from the following description of specific embodiments when read on connection with the accompanying drawings.

DESCRIPTION OF THE PREFERRED EMBODIMENTS

Figure 1:
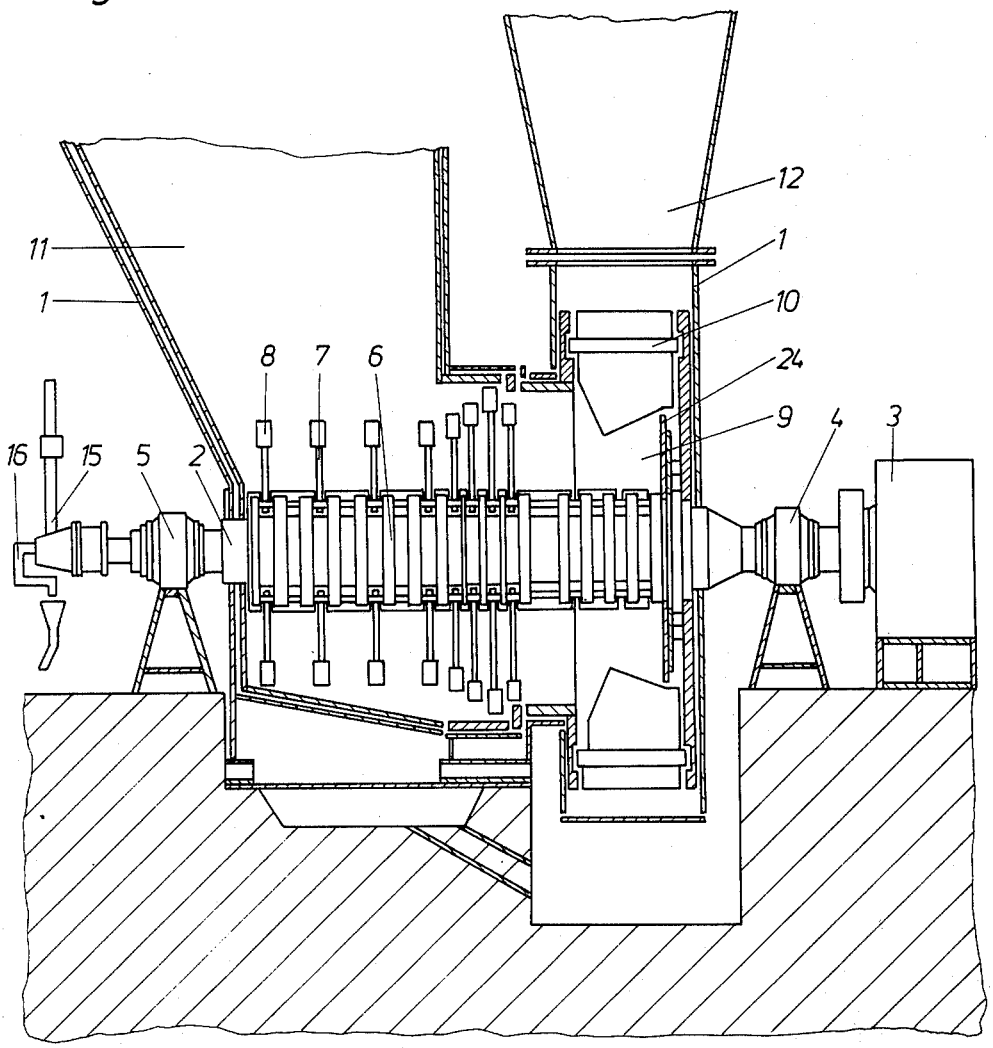
FIG. 1 shows a longitudinal section of a blower-beater mill.
Figure 2:
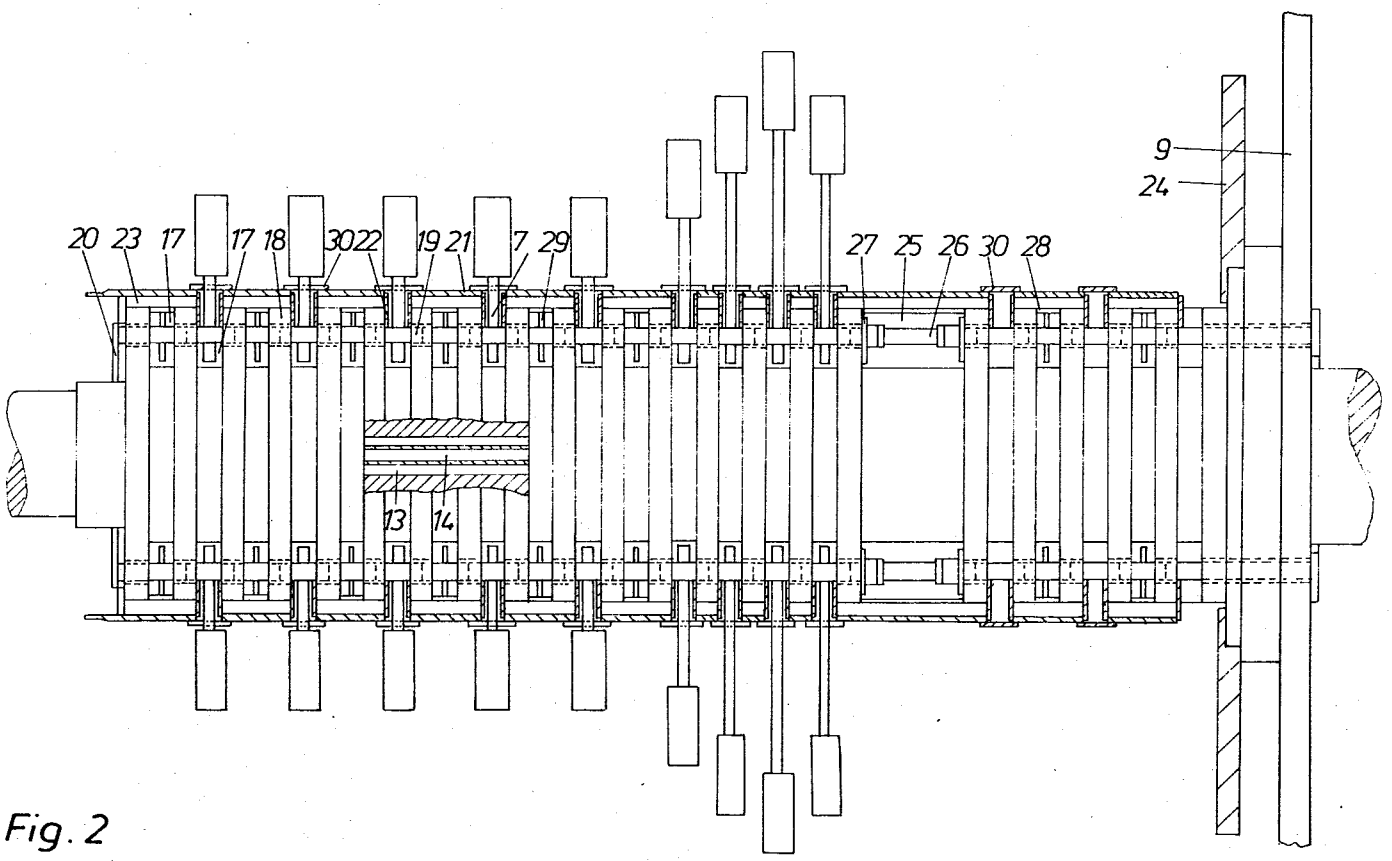
FIG. 2 is a longitudinal section of the shaft of the mill.

The beater-blower mill is provided with a rotor disposed in a housing 1. The rotor comprises a shaft 2 which is driven through a drive by a motor 3 and which is supported in two bearings 4 and 5 located outside the housing 1. A beater body 6 having several rows of beater arms 7 with beater heads 8, as well as an impeller 9 having radical vanes 10 are mounted on the shaft 2.

The impeller 9, which acts as a fan, sucks in hot gases from the boiler room (not shown) through a suction pipe. The material to be milled, in this instance crude brown coal, is fed into the suction pipe and, together with the hot gases, enters the mill through an inlet pipe 11 connected to the suction pipe. The pulverized material is fed to the burners of the boiler through a reducer pipe 12 and a supply pipe connected therewith.

The shaft 2 is internally cooled with water and is to this end provided with a central bore 13 into which a pipe 14 having a smaller diameter is inserted. The pipe 14 is connected to a cooling water feed pipe 15 outside the housing 1, and the annular channel between the pipe 14 and the wall of the bore 13 is connected to a cooling water feedback 16.

Passages 17 are provided in the shaft 2 thus forming hub rings 18. The beater arms 7 are inserted into the passages 17 between the hub rings 18. The arms 7 are supported by means of support pins 19 which pass through bores in the hub rings 18 and the bases of the beater arms 7. The pins 19 are fixed in position by means of lock washers 20 provided on the first and the last hub ring 18 so as to prevent axial displacement.

The hub rings 18 on the shaft 2 are surrounded by a casing consisting of individual rings 21. The hub rings 18 are spaced from the casing. The rings 21 have a U-shaped peripheral section and consist of a portion which extends in the longitudinal direction of the shaft 2 and which is provided with a leg 22 welded perpendicular thereto. The legs 22 together with the beater arms 7 are inserted into the passages 17 between the hub rings 18. In the embodiment shown the legs 22 extend to the pins 19. They may, however, extend to the base of the passages 17 and be provided in their lower portions with a bore through which the pins 19 are inserted.

The rings 21 having the U-shaped peripheral section consist of two half-shells which are joined together over the shaft 2 and which are welded together at the faces of contact. The space between two adjacent rings 21 having the U-shaped peripheral section and two adjacent beater arms 7 within a row of beater arms remains free and is covered by a sheet metal member 30.

The width of the portion of the ring 21 which extends in the longitudinal direction of the shaft 2 depends on the distance between two adjacent rows of beater arms 7. When each passage 17 is provided with beater arms 7 as is shown in the rear portion of the beater body 6, the respective ring 21 overlaps only one hub ring 18. When each second passage 17 remains free as is shown in the front portion of the beater body 6, the ring 21 overlaps two hub rings 18.

Passages 17 are also provided in the portion of the shaft 2 between the beater body 6 and the point of support of the impeller 9. Consequently, this portion of the shaft is identical with the portion of the shaft disposed in the beater body 6. Rings 21 having the U-shaped peripheral section are also inserted into these passages 17 as well as inside the beater body 6. One ring 21 thereby overlaps two hub rings 18. It is also possible for one ring 21 to cover one or three hub rings 18. The use of proportionally narrow rings has the advantage that individual rings 21 can be exchanged when they become defective.

A cooling gas from outside the housing 1 can be passed through the annular intermediate space 23 between the shaft 2 and the rings 21 having the U-shaped peripheral section. Openings for passing the cooling gas therethrough are therefore provided in the vertical legs 22 of the ring 21 above the periphery of the shaft 2. Between the last ring 21 and a deflecting plate 24 on the propeller 9 there remains a gap for the cooling gas to pass through.

Contrary to the embodiment shown, the diameters of the rings 21 along the shaft may differ in size. For instance, the rings in the rear section of the shaft may be larger in diameter than those in the front section. Also, one or more rings may be conical to obtain a gradual transition from the smaller to the larger rings.

To prevent the hub pins 19 which serve the purpose of fixing the beater arms 7 within the beater body 6, from moving, the hub rings 18 in the rear section of the shaft are also provided with bores and hub pins 19. An intermediate passage 25, that is to say, the passage immediately following the last row of beater arms, has been enlarged. Insert pins 26 are fitted in the enlarged passage 25 in the direction of the hub pins 19. Additional lock washers 27 are clamped between both the front faces of the pins 26 and the side faces of corresponding hub rings 18. The hub pins 19 can now be removed from the last hub ring 18 of the beater body 6.

The passages 17 not provided with beater arms 7 are, in addition, covered near the periphery of the shaft. The cover consists of ring-shaped discs 28 provided on the inner face with vertical stems 29. The stems 29 are provided with a bore for engagement of the available hub pins 19.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A blower-beater mill for drying and milling, comprising: a rotor having a beater body and an impeller; a mill shaft mounting said rotor with said beater body and said impeller and being water-cooled along a longitudinal axis; said beater body having beater arms; hub rings on said mill shaft; said beater arms being fastened between said hub rings; a casing enclosing said mill shaft up to said impeller at a spaced distance therefrom, said casing having passages for beater arms in an area of said beater body, said mill shaft having hub rings substantially surrounded by said casing on a portion of said mill shaft between said beater body and said impeller so that individual rows of beater arms may be dismantled and damaged parts of the casing may be replaced, said casing comprising individual U-shaped rings throughout its entire length, said U-shaped rings overlapping at least one of said hub rings and having vertical legs inserted into passages between said hub rings.

2. A blower-beater mill as defined in claim 1 including an enlarged passage behind said beater body; hub pins in bores of said hub rings for supporting said beater arms; insert pins in said passage in an axial direction of said hub pins; lock washers between front faces of said insert pins and side faces of said hub rings.

3. A blower-beater mill as defined in claim 1 including a flow deflecting plate on said impeller, and a gap between said deflecting plate and the last of said U-shaped rings.

4. A blower-beater mill as defined in claim 1 wherein said passages between said hub rings in proximity of the periphery of said mill shaft are covered.

5. A blower-beater mill as defined in claim 1 including an enlarged passage behind said beater body; hub pins in bores of said hub rings for supporting said beater arms; insert pins in said passage in an axial direction of said hub pins; lock washers between front faces of said insert pins and side faces of said hub rings; a flow deflecting plate on said impeller, and a gap between said deflecting plate and the last of said U-shaped rings; said passages between said hub rings in proximity of the periphery of said mill shaft being covered.

* * * * *